US010557265B2

(12) United States Patent
St-Laurent et al.

(10) Patent No.: US 10,557,265 B2
(45) Date of Patent: Feb. 11, 2020

(54) CLIP FOR SUSPENDED CEILING MEMBERS

(71) Applicant: LES PLAFONDS EMBASSY INC., Warwick (CA)

(72) Inventors: André St-Laurent, Warwick (CA); Vincent Gendreau, Warwick (CA)

(73) Assignee: EMBASSY CEILING INC., Warwick, Québec (CA)

( * ) Notice: Subject to any disclaimer, the term of this patent is extended or adjusted under 35 U.S.C. 154(b) by 0 days.

(21) Appl. No.: 16/097,205

(22) PCT Filed: Apr. 26, 2017

(86) PCT No.: PCT/CA2017/000099

§ 371 (c)(1),
(2) Date: Oct. 26, 2018

(87) PCT Pub. No.: WO2017/185167

PCT Pub. Date: Nov. 2, 2017

(65) Prior Publication Data

US 2019/0093350 A1 Mar. 28, 2019

Related U.S. Application Data

(60) Provisional application No. 62/327,533, filed on Apr. 26, 2016.

(51) Int. Cl.

| | |
|---|---|
| ***E04C 2/38*** | (2006.01) |
| ***E04B 9/22*** | (2006.01) |
| ***E04B 9/10*** | (2006.01) |

(Continued)

(52) U.S. Cl.

CPC ..... *E04B 9/22* (2013.01); *E04B 9/04* (2013.01); *E04B 9/10* (2013.01); *E04B 9/14* (2013.01)

(58) Field of Classification Search

CPC .. E04B 9/04; E04B 9/0435; E04B 9/26; E04F 2201/0115; E04F 2201/013; E04F 2201/0146; E04F 2201/0517

See application file for complete search history.

(56) References Cited

U.S. PATENT DOCUMENTS

| | | | | |
|---|---|---|---|---|
| 673,510 A * | 5/1901 | Van Zanten | ..... | E04B 9/26 52/506.09 |
| 6,763,643 B1 * | 7/2004 | Mårtensson | ..... | E04F 15/02 52/403.1 |

(Continued)

*Primary Examiner* — Gisele D Ford
(74) *Attorney, Agent, or Firm* — Praxis

(57) ABSTRACT

A clip for a suspended ceiling being suspended from an overhead structure has at least first and second adjoined ceiling members defining a top surface interfacing with the overhead structure and an opposite undersurface. The top surface of each of the first and second adjoined ceiling members defines at least one slot. The clip comprises a main longitudinal body and a pair of inserts. The main longitudinal body defines opposite ends. Each of the inserts downwardly extend from respective one of the ends of the longitudinal body. Each of the inserts configured to be inserted into a respective one of the slots. The clip is mountable to the first and second adjoined ceiling members with one insert being inserted in the slot of the first ceiling member and the other insert being inserted in the slot of the second ceiling member thereby maintaining the first and second ceiling members in the adjoined position against separation.

9 Claims, 3 Drawing Sheets

(51) Int. Cl.
*E04B 9/14* (2006.01)
*E04B 9/04* (2006.01)

(56) References Cited

U.S. PATENT DOCUMENTS

2002/0095894 A1* 7/2002 Pervan ..... E04F 15/102 52/391
2003/0084636 A1* 5/2003 Pervan ..... E04F 15/04 52/592.1
2003/0196405 A1* 10/2003 Pervan ..... E04F 15/04 52/592.1
2004/0020159 A1* 2/2004 Nelson ..... E04F 15/04 52/741.4
2007/0107359 A1* 5/2007 Zhang ..... E04F 15/02 52/582.1
2007/0289249 A1* 12/2007 Martel ..... E04F 15/02 52/715
2008/0000182 A1* 1/2008 Pervan ..... E04F 15/02 52/478
2008/0276560 A1* 11/2008 Labonte ..... E04B 9/0435 52/506.06
2009/0107076 A1* 4/2009 Kim ..... E04F 15/02 52/582.1
2009/0151290 A1* 6/2009 Liu ..... E04F 15/04 52/586.1
2010/0257808 A1* 10/2010 Baxter ..... E04B 9/363 52/586.1
2012/0055109 A1* 3/2012 Labonte ..... E04B 9/22 52/506.05
2013/0167467 A1* 7/2013 Vermeulen ..... E04F 15/02 52/588.1
2014/0026513 A1* 1/2014 Bishop ..... E04F 15/02016 52/589.1
2014/0109505 A1* 4/2014 St-Laurent ..... E04B 9/10 52/506.08
2015/0167297 A1* 6/2015 St-Laurent ..... E04B 9/20 52/506.05
2015/0292216 A1* 10/2015 St-Laurent ..... E04F 15/02038 52/588.1
2016/0060880 A1* 3/2016 Stover ..... E04F 15/02044 52/582.2
2016/0168865 A1* 6/2016 Pervan ..... E04F 15/02016 52/309.1
2016/0237695 A1* 8/2016 Pervan ..... E04F 15/02038
2016/0273230 A1* 9/2016 Yang ..... E04F 15/02038
2017/0314591 A1* 11/2017 Baker ..... F16B 5/002
2018/0355618 A1* 12/2018 Bevernage ..... E04F 13/0801

* cited by examiner

CLIP FOR SUSPENDED CEILING MEMBERS

CROSS-REFERENCE TO RELATED APPLICATIONS

The present application claims priority on U.S. Provisional Patent Application No. 62/327,533 filed on Apr. 26, 2016 and incorporated herein by reference in its entirety.

TECHNICAL FIELD

The present disclosure generally relates to suspended ceilings. More particularly but not exclusively, the present disclosure relates to a clip for suspended ceiling members.

BACKGROUND

Suspended ceilings are secondary ceiling that are suspended from an overhead structure. Suspended ceilings include suspended ceiling members such as runners, cross members and panels. These ceiling members have a top side surface that interface with the overhead structure and an opposite underside surface. Usually, suspended ceiling are made of a metal grid consisting of tracks in the form of longitudinal parallel runners spaced apart from one another at a desired distance and separated by cross members in a perpendicular fashion thereby creating a plurality of rectangular openings for receiving rectangular panels. In general, those rectangular openings are of standard sizes allowing the ventilation outlets and the lighting fixtures to be easily inserted among the ceiling panels.

OBJECTS

An object of the present disclosure is to provide a clip for suspended ceiling members.

An object of the present disclosure is to provide a suspended ceiling comprising clip for the ceiling members thereof.

An object of the present disclosure is to provide a kit for a suspended ceiling comprising ceiling members and a clip therefor.

A method of constructing a suspended ceiling.

SUMMARY

In accordance with an aspect of the disclosure, there is provided a clip for a suspended ceiling being suspended from an overhead structure and having at least first and second adjoined ceiling members defining a top surface interfacing with the overhead structure and an opposite undersurface, the top surface of each of the first and second adjoined ceiling members defining at least one slot, the clip comprising: a main longitudinal body defining opposite ends; and a pair of inserts, each of the inserts downwardly extending from respective one of the ends of the longitudinal body, each of the inserts configured to be inserted into a respective one of the slots, wherein the clip is mountable to the first and second adjoined ceiling members with one insert being inserted in the slot of the first ceiling member and the other insert being inserted in the slot of the second ceiling member thereby maintaining the first and second ceiling members in the adjoined position against separation.

In accordance with an aspect of the disclosure, there is provided a suspended ceiling for being suspended from an overhead structure, the suspended ceiling comprising: at least first and second adjoined ceiling members defining a top surface interfacing with the overhead structure and an opposite undersurface, the top surface of each of the first and second adjoined ceiling members defining at least one slot; a clip comprising a main longitudinal body defining opposite ends and a pair of inserts, each of the inserts downwardly extending from respective one of the ends of the longitudinal body, each of the inserts configured to be inserted into a respective one of the slots, wherein the clip is mountable to the first and second adjoined ceiling members with one insert being inserted in the slot of the first ceiling member and the other insert being inserted in the slot of the second ceiling member thereby maintaining the first and second ceiling members in the adjoined position against separation.

In accordance with an aspect of the disclosure, there is provided a kit for a suspended ceiling for being suspended from an overhead structure, the kit comprising: at least first and second adjoined ceiling members defining a top surface interfacing with the overhead structure and an opposite undersurface, the top surface of each of the first and second adjoined ceiling members defining at least one slot; a clip comprising a main longitudinal body defining opposite ends and a pair of inserts, each of the inserts downwardly extending from respective one of the ends of the longitudinal body, each of the inserts configured to be inserted into a respective one of the slots, wherein the clip is mountable to the first and second adjoined ceiling members with one insert being inserted in the slot of the first ceiling member and the other insert being inserted in the slot of the second ceiling member thereby maintaining the first and second ceiling members in the adjoined position against separation.

In an embodiment, each of the inserts forms an acute angle with the main longitudinal body, each slot comprising a corresponding angular configuration.

In an embodiment, the main longitudinal body is a flat member.

In an embodiment, the clip further comprises flexible and resilient material.

In an embodiment, each of the insert defines with the main longitudinal body a respective corner portion therebetween. In an embodiment, each of the corner portions comprises a flexible and resilient material.

In an embodiment, each insert is a separate piece mountable to the main longitudinal body.

In an embodiment, the main longitudinal body is modular. In an embodiment, the modular longitudinal body comprises at least two pieces which are connectable.

In accordance with an aspect of the disclosure, there is provided a method of constructing a suspended ceiling for being suspended from an overhead structure, the method comprising: providing at least first and second ceiling members defining a top surface interfacing with the overhead structure and an opposite undersurface, adjoining the first and second ceiling members; providing at least one slot on the top surface of each of the first and second adjoined ceiling members; providing a clip comprising a main longitudinal body defining opposite ends and a pair of inserts, each of the inserts downwardly extending from respective one of the ends of the longitudinal body, each of the inserts configured to be inserted into a respective one of the slots; and mounting the clip to the first and second adjoined ceiling members by inserting one insert in the slot of the first ceiling member and the inserting the other insert in the slot of the second ceiling member thereby maintaining the first and second ceiling members in the adjoined position against separation.

In an embodiment, the method further comprises varying the length of the main longitudinal body.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with a non-restrictive illustrative embodiment, there is provided a clip for a suspended ceiling being suspended from an overhead structure having at least first and second adjoined ceiling members defining a top surface interfacing with the overhead structure and an opposite undersurface. The top surface of each of the first and second adjoined ceiling members defines at least one slot. The clip comprises a main longitudinal body and a pair of inserts. The main longitudinal body defines opposite ends. Each of the inserts downwardly extend from respective one of the ends of the longitudinal body. Each of the inserts configured to be inserted into a respective one of the slots. The clip is mountable to the first and second adjoined ceiling members with one insert being inserted in the slot of the first ceiling member and the other insert being inserted in the slot of the second ceiling member thereby maintaining the first and second ceiling members in the adjoined position against separation.

With reference to the Figures, non-limiting illustrative embodiments will now be described.

Figure 1:
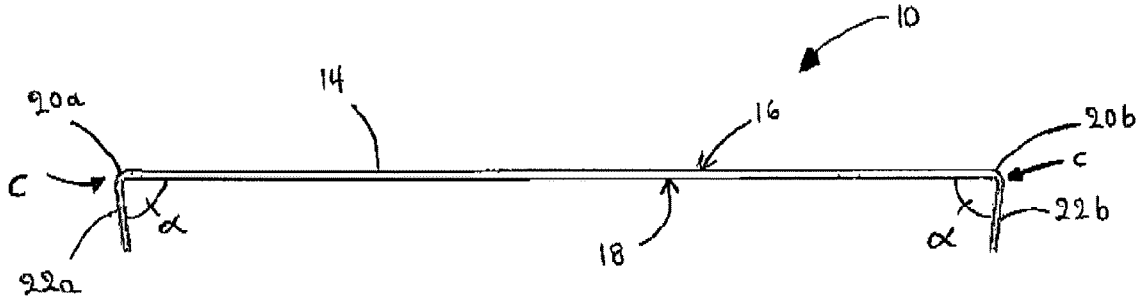
FIG. 1 is a lateral side view of the clip for the ceiling members of a suspended ceiling in accordance with a non-restrictive illustrative embodiment thereof.
Figure 2:
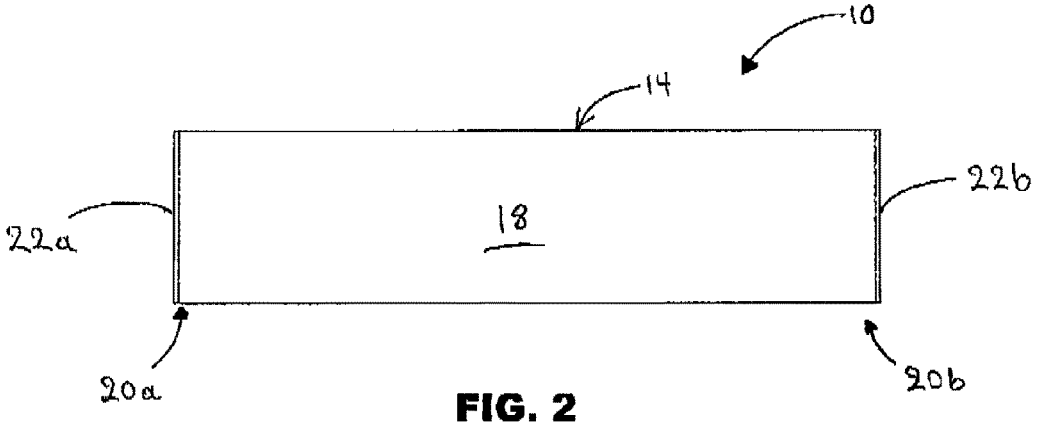
FIG. 2 is an underside view of the clip of FIG. 1.

FIGS. 1 and 2 show a clip 10 for ceiling members of a suspended ceiling structure 12 (shown in FIGS. 3 and 4) or suspended ceiling structure 12' (shown in FIGS. 5 and 6) that is suspended from an overhead structure (not shown).

The clip 10 includes a main longitudinal body 14 defining a top side 16 and an opposite underside 18 as well as two opposite ends 20*a* and 20*b*. The clip 10 includes a pair of inserts 22*a* and 22*b*. Each insert 22*a* and 22*b* downwardly extends from a respective end 20*a* and 20*b*. Respective corner portions C are defined between each insert 22*a*, 22*b* and the main longitudinal body 14.

The clip 10 is made of a strong, flexible and resilient material in order to maintain the ceiling members of the suspended ceiling structures 12 and 12' in position against separation as will be described herein.

Figure 3:
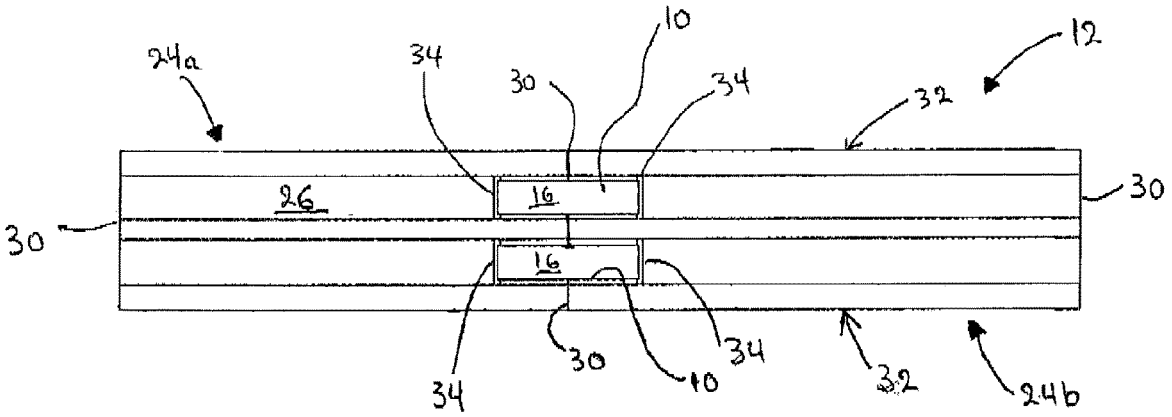
FIG. 3 is a top plan view of suspended ceiling structure having adjoined ceiling members positioned end to end and connected by a pair of the clips of FIG. 1 in accordance with a non-restrictive illustrative embodiment thereof.
Figure 4:
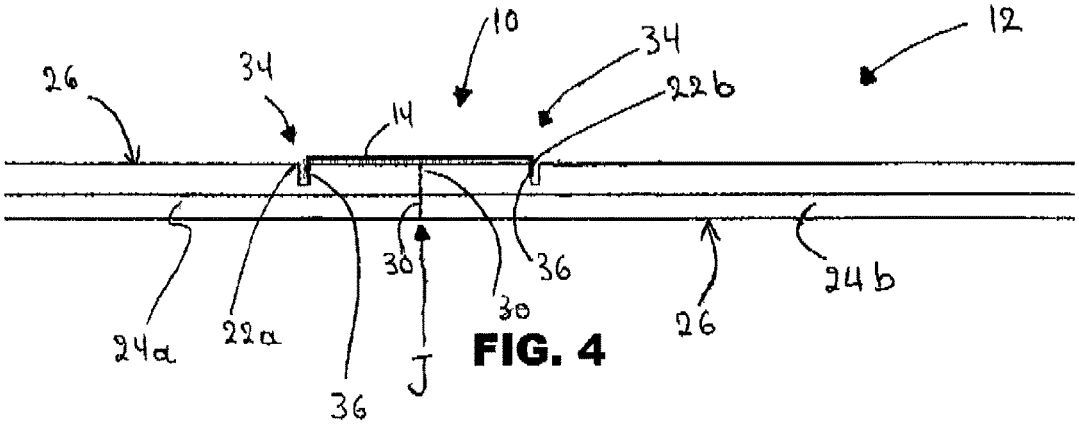
FIG. 4 is a lateral sectional view of FIG. 1 taken along line 4-4 thereof.

Turning to FIGS. 3 and 4, a pair of clips 10 are shown to be mounted to adjoined first and second ceiling members 24*a* and 24*b*, respectively.

Each of the ceiling members 24*a* and 24*b* defines a top side surface 26 that interfaces with the overhead structure (now shown) and an opposite underside surface 28. The ceiling members 24*a* and 24*b* are longitudinal structures defining respective and opposite longitudinal ends 30 as well as opposite lateral sides 32, The top side surface 26 of each of the ceiling members 24*a* and 24*b* includes at least one slot 34. Each slot 34 is configured to receiving one of the inserts 22*a* or 22*b*. As such, each insert 22*a* or 22*b* is configured to be inserted within a given slot 34.

When the ceiling members 24*a* and 24*b* are adjoined end 30 to end 30, the clip 10 is mounted on the respective top surfaces 26 of the ceiling members 24*a* and 24*b* about the junction J thereof with the underside 18 of the main longitudinal body 14 interfacing with the top surfaces 26 of the ceiling members and the junction J. The underside 18 can be spaced apart from the top surfaces 26 or engage them. The longitudinal body 14 of the clip 10 extends from the slot 34 of the first ceiling member 24*a* to the slot 34 of the second ceiling member 24*b*. The first insert 22*a* is inserted within the slot 34 of the first ceiling member 24*a*. The second insert 22*b* is inserted within the slot 34 of the second ceiling member 24*b*. The slots 34 are defined by spaced apart walls 36 (see FIG. 4), In an embodiment, each insert 22*a* and 22*b* engages the wall 36 that is proximal to the junction J of the respective slot 34 they are inserted in. As such, the clip 10, clips therebetween a portion of the first and second ceiling member 24*a* and 24*b* maintaining the ceiling members together against separation about the junction J.

Turning back to FIG. 1, in an embodiment, each insert 22*a* and 22*b* forms a respective acute angle $\alpha$ with the underside 18 of the longitudinal body 14. In this way, the clip 10 inwardly grips the walls 36 of the first and second ceiling members 24*a* and 24*b*. When the members 24*a* and 24*b* are slightly moved away from each other during assembly or due to other factors such as humidity, the inserts 22*a* and 22*b* are moved against their angular direction increasing the stress applied on the walls 36 at each side of the junction J to maintain the adjoined ceiling members 24*a* and 24*b* in position against separation.

Figure 5:
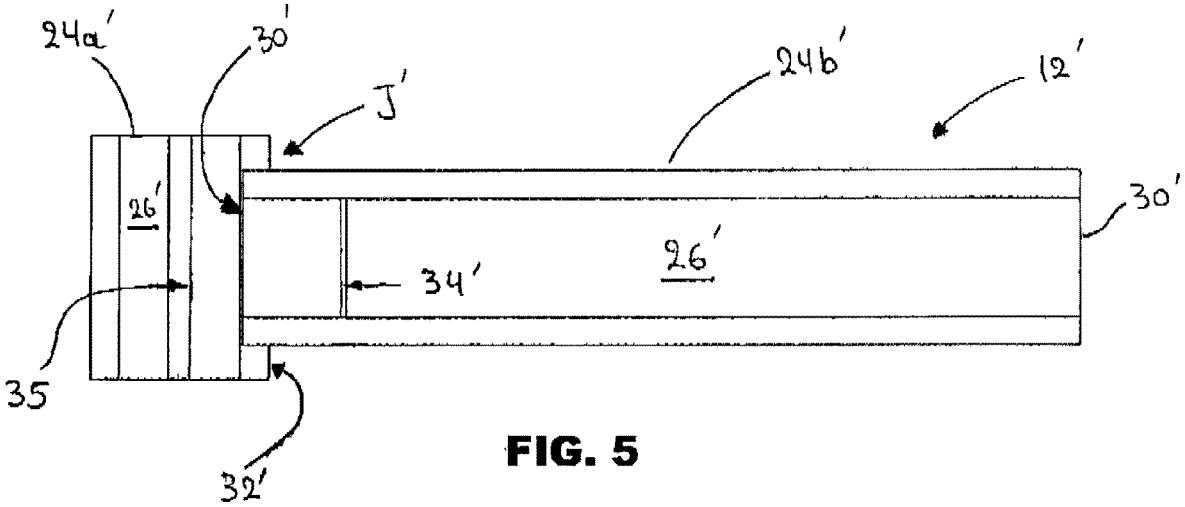
FIG. 5 is a top plan view of a suspended ceiling structure having adjoined ceiling members perpendicularly positioned thereof to each other in accordance with a non-restrictive illustrative embodiment thereof.
Figure 6:
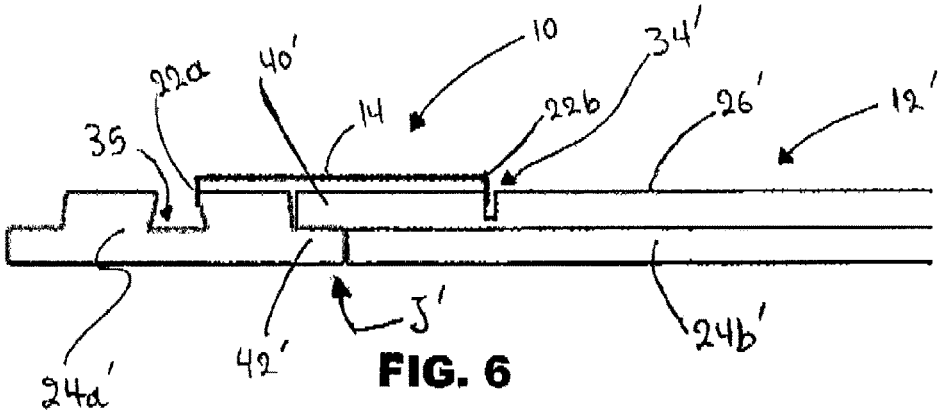
FIG. 6 is a lateral side view of the suspended ceiling structure of FIG. 5 having the clip of Figure mounted to the ceiling members thereof.

Turning now to FIGS. 5 and 6, there is shown a suspended ceiling structure 12' including first and second ceiling members 24*a'* and 24*b'* adjoined together in a perpendicular relationship relative to each other. The first ceiling member 24*a'* is abutted on its lateral side 32' by the longitudinal end 30' of the second ceiling member 24*b'* and a junction J'. The abutting lateral side 32' of the first ceiling member 24*a'* and the abutting end 30' of the second ceiling member 24*b* have a complementary configurations, wherein a protruding upper portion 40' of end 30' sits on a protruding lower portion 42' of later side 32'.

Like ceiling members 24*a* and 24*b* described above, the second ceiling member 24*b'* also include at least one respective slot 34' formed on its top side surface 26'. The first ceiling member 24*a'* also includes a slot 35' on its top side surface 26'. In an embodiment, the slot 35' can also receiving a clip assembly (not shown) for mounting the first ceiling member 24*a*' to the overhead structure (now shown). In an embodiment, the slot 35' has a dovetail configuration. Of course, other suitable configurations can also be contemplated.

The clips 10 are mounted on the top surfaces of the ceiling members in the overhead area (the area above the suspended ceiling beneath the overhead structure), as such these removable clips 10 can maintain adjoined ceiling members in position against separation all the while not disturbing the aesthetic appearance of the suspended ceilings.

The clips 10 may be provided as separate elements or in kits along with the ceiling members.

Figure 7:
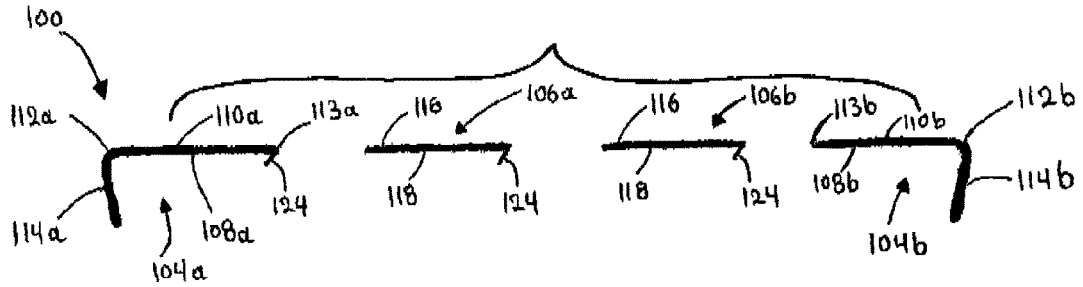
FIG. 7 is a side view of a disassembled modular clip for the ceiling members of a suspended ceiling in accordance with another non-restrictive Illustrative embodiment thereof.
Figure 8:
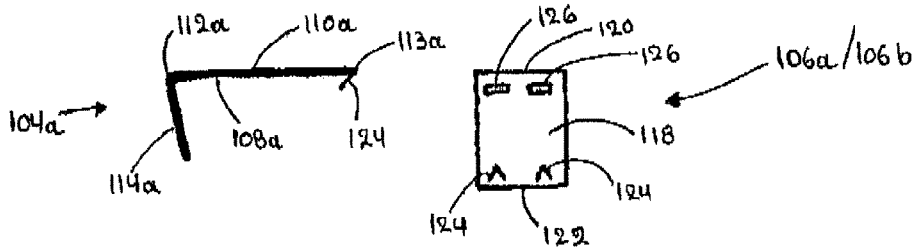
FIG. 8 is a side view of one component and a bottom view of another component of the modular clip of FIG. 7.

FIGS. 7 and 8 show a modular clip 100, where the main longitudinal body 102 is modular and comprises separate body components, namely end body components 104*a* and 104*b* and median body components 106*a* and 106*b*, In an embodiment, the clip 100 includes a greater or lesser number of median body components 106*a* or 106*b*.

The end body components 104*a* and 104*b* comprise respective underside surfaces 108*a* and 108*b* and respective top surfaces 110*a* and 110. Each body component 104*a* and 104*b* defines respective ends 112*a* and 112*b* connected to respective inserts 114*a* and 114*b* and respective opposite free ends 113*a* and 113*b*.

A given median body component 106*a* or 106*b* defines top and underside surfaces 116 and 118, respectively, as well as first and second ends 120 and 122, respectively, The terms "first" and "second" are used here for indicative purposes only and thus are interchangeable.

The body components are connected together via teeth or hook elements 124 of one body component being inserted into the corresponding apertures 126 of another body component. Of course, other connecting elements for varying the length of the modular longitudinal body 102 can be contemplated by the skilled artisan within the scope of the description.

Figure 9:
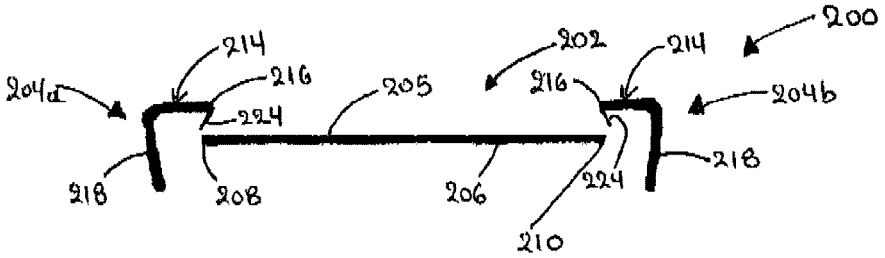
FIG. 9 is a side view of a disassembled modular clip for the ceiling members of a suspended ceiling in accordance with a further non-restrictive illustrative embodiment thereof.
Figure 10:
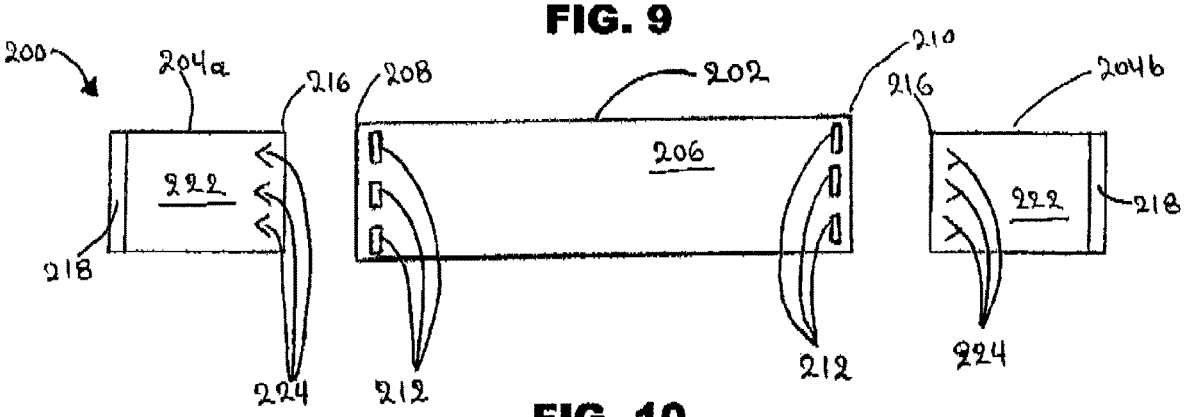
FIG. 10 is bottom view of the modular clip of FIG. 9.

Turning now to FIGS. 9 and 10, there is shown a clip 200 comprising a main longitudinal body 202 and a pair of separate end body components 204*a* and 204*b* mountable thereto.

The main longitudinal body 202 defines top and underside surfaces 205 and 206 respectively and opposite ends 208 and 210 as well as apertures 212 near each end, 208 and 210.

Each separate body component, 204*a* and 204*b* defines an end top portions 214 defining a free end 216 with an insert 218 connected thereto as well as top and underside surfaces, 220 and 222 respectively. The top portion 214 includes teeth or hook elements 224 protruding from the underside surface 222 near the free end 216. The teeth or hooks 224 are fitted within the apertures 212 for connecting the end body components 204*a* and 204*b* to the main longitudinal body 202.

The present disclosure is also drawn to suspended ceilings including the clips and ceiling members disclosed herein as well as methods of constructing suspended ceilings with the clips and ceiling members disclosed herein.

The clips and ceiling members of the present disclosure may be provided in a variety of suitable shapes and sizes that are convenient to use as described herein and may be made of a variety of suitable materials.

The various features described herein can be combined in a variety of ways within the context of the disclosure so as to provide still other embodiments. It is to be understood that the disclosure is not limited in its application to the details of construction and parts illustrated in the accompanying drawings and described hereinabove. The disclosure is capable of other embodiments and of being practiced in various ways. It Is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature of the disclosure and appended claims

What is claimed is:

1. A clip for a suspended ceiling being suspended from an overhead structure and having at least first and second adjoined ceiling members defining a top surface interfacing with the overhead structure and an opposite undersurface, the top surface of each of the first and second adjoined ceiling members defining at least one slot, the clip comprising:

a main longitudinal flat body defining opposite ends, the main longitudinal body being modular, wherein the modular longitudinal body comprises at least two body components which are connectable via hook elements of one of the body components being inserted into corresponding apertures of another adjacent one of the body components; and a pair of flat inserts, each of the inserts downwardly extending from respective one of the ends of the longitudinal body, each of the inserts configured to be inserted into a respective one of the slots, each of the inserts defines with the main longitudinal body a respective end corner portion therebetween, each of the inserts forms an acute angle with the main longitudinal body, each slot defining walls comprising a corresponding angular configuration, the inserts inwardly gripping the walls defined by the slots, wherein the clip is mountable to the first and second adjoined ceiling members with one insert being inserted in the slot of the first ceiling member and the other insert being inserted in the slot of the second ceiling member thereby maintaining the first and second ceiling members in the adjoined position against separation.

2. A clip according to claim 1, wherein the clip further comprises flexible and resilient material.

3. A clip according to claim 1, wherein each of the corner portions comprises a flexible and resilient material.

4. A clip according to claim 1, wherein each insert is a separate piece mountable to the main longitudinal body.

5. A suspended ceiling according to claim 1, wherein the clip further comprises flexible and resilient material.

6. A suspended ceiling for being suspended from an overhead structure, the suspended ceiling comprising:

at least first and second adjoined ceiling members defining a top surface interfacing with the overhead structure and an opposite undersurface, the top surface of each of the first and second adjoined ceiling members defining at least one slot;

a clip comprising: modular, a main longitudinal flat body defining opposite ends, the main longitudinal body being modular, wherein the modular longitudinal body comprises at least two body components which are connectable via hook elements of one of the body components being inserted into corresponding apertures of another adjacent one of the body components; and a pair of flat inserts, each of the inserts downwardly extending from respective one of the ends of the longitudinal body, each of the inserts configured to be inserted into a respective one of the slots, each of the inserts defines with the main longitudinal body a respective end corner portion therebetween, each of the inserts forms an acute angle with the main longitudinal body, each slot comprising a corresponding angular configuration, each slot defining walls comprising a corresponding angular configuration, the inserts inwardly gripping the walls defined by the slots, wherein the clip is mountable to the first and second adjoined ceiling members with one insert being inserted in the slot of the first ceiling member and the other insert being inserted in the slot of the second ceiling member thereby maintaining the first and second ceiling members in the adjoined position against separation.

7. A suspended ceiling according to claim 6, wherein each of the corner portions comprises a flexible and resilient material.

8. A suspended ceiling according to claim 6, wherein each insert is a separate piece mountable to the main longitudinal body.

9. A kit for a suspended ceiling for being suspended from an overhead structure, the kit comprising:

at least first and second adjoined ceiling members defining a top surface interfacing with the overhead structure and an opposite undersurface, the top surface of each of the first and second adjoined ceiling members defining at least one slot;

a clip comprising: a a main longitudinal flat body defining opposite ends, the main longitudinal body being modular, wherein the modular longitudinal body comprises at least two body components which are connectable via hook elements of one of the body components being inserted into corresponding apertures of another adjacent one of the body components; and a pair of flat inserts, each of the inserts downwardly extending from respective one of the ends of the longitudinal body, each of the inserts configured to be inserted into a respective one of the slots, each of the inserts defines with the main longitudinal body a respective end corner portion therebetween, each of the inserts forms an acute angle with the main longitudinal body, each slot comprising a corresponding angular configuration each slot defining walls comprising a corresponding angular configuration, the inserts inwardly gripping the walls defined by the slots, wherein the clip is mountable to the first and second adjoined ceiling members with one insert being inserted in the slot of the first ceiling member and the other insert being inserted in the slot of the second ceiling member thereby maintaining the first and second ceiling members in the adjoined position against separation.

* * * * *